United States Patent [19]

Foss et al.

[11] Patent Number: 4,543,446

[45] **Date of Patent: * Sep. 24, 1985**

[54] VAPORIZATION-COOLED TRANSFORMER HAVIG PROVISIONS FOR REPLENISHMENT OF MOLECULAR SIEVE MATERIAL

[75] Inventors: Stephen D. Foss; Giovanni Colantuoni, both of Pittsfield, Mass.

[73] Assignee: General Electric Company, King of Prussia, Pa.

[ * ] Notice: The portion of the term of this patent subsequent to Jun. 24, 2000 has been disclaimed.

[21] Appl. No.: 232,857

[22] Filed: Feb. 9, 1981

[51] Int. Cl.[4] ..... H01F 27/10

[52] U.S. Cl. ..... 174/11 R; 174/14 R; 174/15 R; 336/58

[58] Field of Search ..... 174/11 R, 14 R, 15 R; 336/55, 57, 58

[56] References Cited

U.S. PATENT DOCUMENTS 4,234,754 11/1980 Edwards et al. ..... 174/14 R

*Primary Examiner*—Laramie E. Askin

*Attorney, Agent, or Firm*—Robert A. Cahill

[57] ABSTRACT

Molecular sieve material is placed in the main condensate return in vaporization-cooled transformers. The sieve material can be removed and replenished without de-energizing the transformer.

3 Claims, 1 Drawing Figure

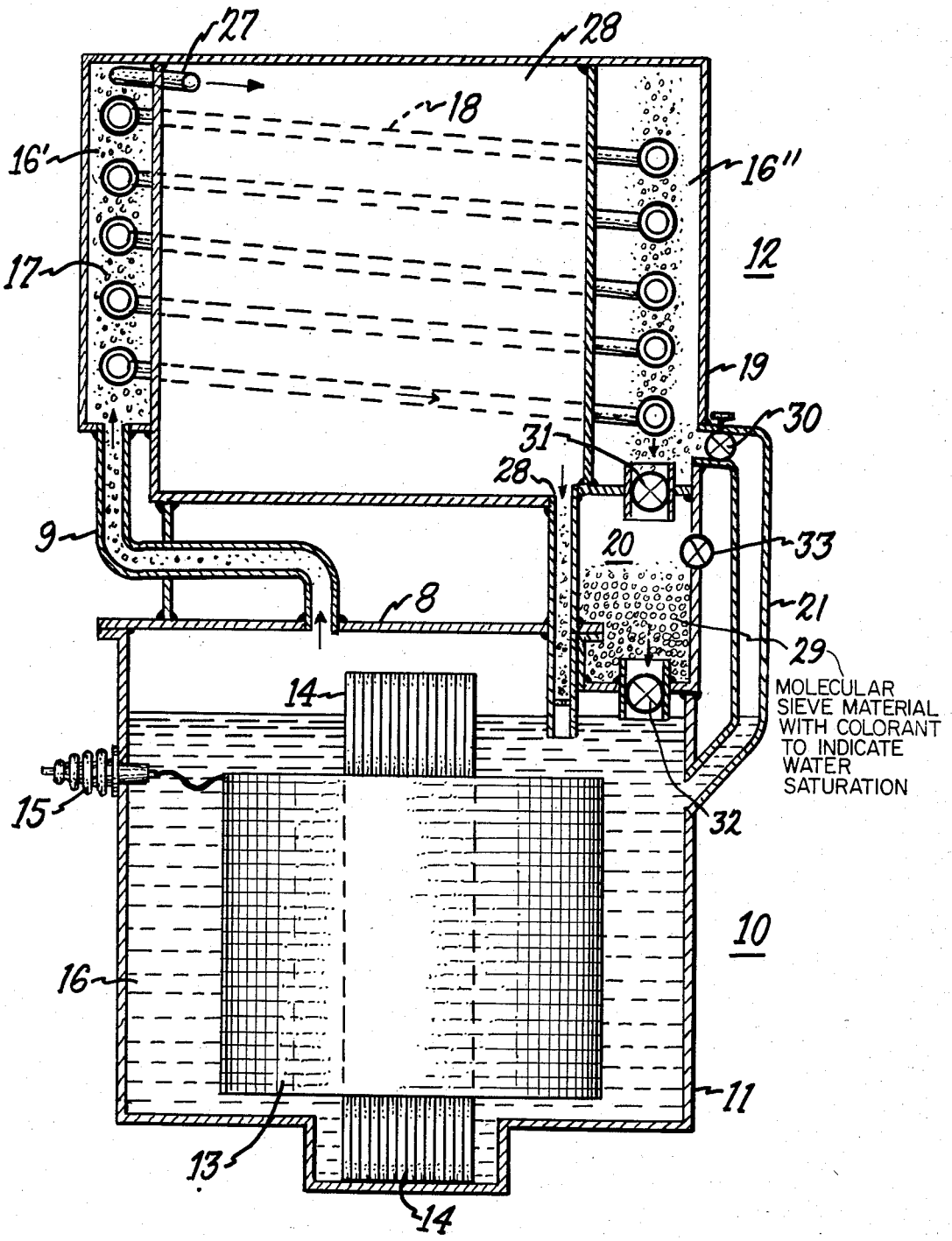
27
28
18
16'
16''
12
17
19
30
31
28
9
20
33
8
21
29
MOLECULAR SIEVE MATERIAL WITH COLORANT TO INDICATE WATER SATURATION
14
15
32
10
16
11
13
14

VAPORIZATION-COOLED TRANSFORMER HAVIG PROVISIONS FOR REPLENISHMENT OF MOLECULAR SIEVE MATERIAL

BACKGROUND OF THE INVENTION

U.S. patent application, Ser. No. 110,046 filed Jan. 7, 1980 and incorporated herein for purposes of reference, discloses the placement of molecular sieve material both in the flow and return paths of the condensable dielectric coolant used in vapor-cooled transformers. The placement of the molecular sieve material in the path of the vaporized coolant provides for the removal of a quantity of water vapor from the coolant in vapor form. The molecular sieve material in the liquid return path removes any water existing when the coolant is in condensed form.

Since water is continuously evolved from the cellulosic insulation material used within the transformer winding, a substantial quantity of molecular sieve material must be employed within the vapor path in order to insure that the molecular sieve material does not become saturated and inoperative over the entire life of the transformer.

It has since been determined that the more efficient mechanism for water adsorption is when the water is in a condensed state upon contact with the molecular sieve-adsorbing surface. The proper placement of molecular sieve material thereby allows a smaller quantity of sieve material to be employed at a substantial saving both in transformer size and in the quantity of molecular sieve material employed.

The purpose of this invention is to describe an arrangement for using small quantities of molecular sieve material efficiently employed for water adsorption and means for removing and replacing the molecular sieve material upon saturation.

SUMMARY OF THE INVENTION

The invention comprises the imposition of a valved container of molecular sieve material in the main condensate return path of a vaporization-cooled transformer to adsorb any water existing within the transformer in a condensed state. A valved condensate return bypass line, in combination with the valved molecular sieve container, allows the molecular sieve material to be removed and replenished without interfering with the operation of the transformer. In one embodiment the valved container comprises a transparent material for observing any color change that occurs when the molecular sieve material is water-saturated.

BRIEF DESCRIPTION OF THE DRAWING

The single FIGURE is a front sectional view of a vapor-cooled transformer employing the molecular sieve arrangement according to the invention.

DESCRIPTION OF THE PREFERRED EMBODIMENT

The single FIGURE shows a vaporization-cooled transformer 10 of the type employing a transformer tank 11 connected with a heat exchanger assembly 12. A winding arrangement 13 and a transformer core 14 are included within tank 11 and a feed-through bushing 15 permits electrical connections with winding arrangement 13. In order to provide dielectric and cooling facility to both winding arrangement 13 and core 14, a quantity of condensable dielectric coolant 16 is included within tank 11. The condensable coolant comprises a chlorinated fluorocarbon such as trichlorotrifluoroethane which becomes heated during transformer operation and vaporizes. The vapor flow path is indicated by arrows and proceeds through an opening in tank cover 8 into an inlet 9 to an intake manifold 17. A plurality of cooling tubes 18 interconnect between intake manifold 17 and an exit manifold 19 whereby vaporized coolant 16' enters cooling tubes 18 and condenses to form liquid droplets 16" before returning to tank 11 by means of exit manifold 19. An expansion tank inlet 27 connects between intake manifold 17 and expansion tank 28 to allow for the expansion of any noncondensable gasses remaining within transformer tank 11 before transformer 10 becomes energized. A quantity of molecular sieve material can be included within expansion tank 28 in order to adsorb any water vapor within the expansion tank as described in the aforementioned U.S. patent application. Any coolant 16 remaining within expansion tank 28 can return to tank 11 by means of an expansion tank outlet 28. In accordance with the instant invention, a container 20 is incorporated between exit manifold 19 and tank 11 in order to receive condensed coolant 16" upon return to tank 11. As described earlier, it was determined that the efficiency of water adsorption on the surface of molecular sieve material 29 is greatly improved if the coolant 16 is in liquid rather than vapor form upon contact with the surface of molecular sieve material 29. The imposition of molecular sieve material 29 in container 20 assures that any dielectric coolant 16 contacting molecular sieve material 29 will be in liquid form as condensed droplets 16" indicate. Further, the placement of molecular sieve material 29 in the condensate return path assures that the temperature of the molecular sieve material will be at a low temperature to further increase the adsorption efficiency. When the molecular sieve material 29 is a zeolite substance such as manufactured by the Linde Corporation, suitable colorants can be added so that a color change occurs when the molecular sieve material becomes saturated with water. In order to continuously view the molecular sieve material, container 20 can be fabricated from plastic or glass material or can contain a transparent sight glass to provide visual access to the condition and color of molecular sieve material 29. When it is determined that molecular sieve material 29 has become saturated, then the molecular sieve material can be removed in the following manner. Bypass valve 30, which is normally closed during transformer operation, is opened in order to provide a path for condensed coolant 16" through condensate return bypass line 21 back to tank 11. First valve 31, which is normally open, and second valve 32, which is normally open, are both closed in order to isolate container 20 from exit manifold 19 and tank 11. Container 20 is then bypassed and molecular sieve material 29 is accessible through valved opening 33 for treatment in order to remove any water vapor adsorbed therein by heating and/or vacuum treating. Alternatively, a fresh supply of molecular sieve material 29 can be introduced within container 20. Bypass valve 30 is then closed and valves 31 and 32 are opened to redirect the path of condensed coolant 16" through molecular sieve material 29 within container 20 back to tank 11. The frequency of replacement of molecular sieve material 29 depends to a large extent upon the degree of loading employed for vaporization-cooled transformer 10. When the transformer is operated above 100% of rated load, the degree of outgassing from winding arrangement 13 is substantially greater than when the transformer is operated, for example, at 50% to 75% of rated load. It may be advantageous to operate vaporization-cooled transformer 10 greater than 100% of rated voltage in order to drive the water vapor out of the cellulosic materials within winding arrangement 13 for the first several hundred hours of operation. Molecular sieve material 28 could then be removed and either regenerated or replaced. The transformer could then be operated slightly lower than 100% voltage rating and molecular sieve material 29 could then operate for long periods of time before saturation occurs and replenishment becomes necessary. In the event that molecular sieve material 29 is to be outgassed, rather than replaced, a simple heating and evacuation procedure can be employed with container 20 remaining in place within vaporization-cooled transformer 10. Bypass valve 30 connecting condensate return bypass line 21 can be opened and valves 31 and 32 can be closed. Valve 33 connecting with container 20 above the surface of molecular sieve material 29 is now opened and connection is made with a vacuum pump. The vacuum pump is operated until the adsorbed moisture within molecular sieve material 29 is removed whereupon valves 30 and 33 are closed. Valves 31 and 32 are reopened in order to continue the flow of condensed coolant 16″ through container 20 and in contact with molecular sieve material 29.

We claim:

1. In a vaporization-cooled transformer having a transformer tank, a heat exchanger and an internal condensate return path for conveying condensed dielectric coolant from the heat exchanger to the tank, the combination comprising:

a container located in the condensate return path, said container including an inlet communicating with the heat exchanger and an outlet communicating with the transformer tank;

a quantity of molecular sieve material accommodated in said container;

separate valve means in said inlet and outlet for controlling the flow of condensed dielectric coolant through said container;

a bypass conduit connected between the heat exchanger and the transformer tank;

additional valve means in said conduit for controlling the flow of condensed dielectric coolant therethrough; and a valved opening in said container affording access from externally of the transformer to said molecular sieve material for the replenishment thereof while said container remains in situ and isolated from the condensate return path by said valve means and said bypass conduit.

2. The apparatus of claim 1 wherein said molecular sieve material includes a colorant for indicating when said molecular sieve material is saturated with water.

3. The apparatus of claim 2 wherein said molecular sieve container includes a transparent portion for providing visual access with said molecular sieve material.

* * * * *